United States Patent [19]

Shay

[11] 4,325,500

[45] Apr. 20, 1982

[54] EXTENDED SPRAY PUMP

[75] Inventor: Joseph J. Shay, Manchester, N.H.

[73] Assignee: Ethyl Products Company, Richmond, Va.

[21] Appl. No.: 202,612

[22] Filed: Oct. 31, 1980

[51] Int. Cl.[3] ..... B05B 11/02

[52] U.S. Cl. ..... 222/321; 222/340; 222/385

[58] Field of Search ..... 417/328, 559, 566; 239/333; 222/321, 372, 383, 385, 380, 340

[56] References Cited

U.S. PATENT DOCUMENTS 3,761,022 9/1973 Kondo ..... 222/340 X
3,921,861 11/1975 Kondo ..... 222/340
4,051,983 10/1977 Anderson ..... 222/321
4,154,374 5/1979 Kirk, Jr. ..... 239/333 X
4,228,931 10/1980 Ruscitti et al. ..... 222/321

FOREIGN PATENT DOCUMENTS 2346056 10/1977 France ..... 222/321

*Primary Examiner*—David A. Scherbel
*Attorney, Agent, or Firm*—Donald L. Johnson; John F. Sieberth

[57] ABSTRACT

A finger operated accumulative pressure spray pump which has two opposing and coaxial chambers. The upper chamber is fitted with an upper and middle piston urged upwardly by a spring, and the lower chamber is fitted with an opposing piston urged upwardly by a spring. A port connects the space between the two upper pistons with the external atmosphere.

10 Claims, 9 Drawing Figures

EXTENDED SPRAY PUMP

BACKGROUND OF THE INVENTION

1. Field of the Invention

The present invention relates to finger operated spray pumps. In particular this invention relates to an accumulative pressure spray pump that upon repeated actuation will produce a continuous discharge.

2. Description of the Prior Art

Many conventional spray pumps produce a spray which varies in pressure and volume in proportion to the force applied by the finger of the user actuating the pump. If the force applied by the finger is relatively small, the spray will not be highly atomized.

To achieve rapid atomization and the production of a high degree of atomization of the spray, double cylinder-double piston pumps, sometimes known as accumulative pressure pumps, have been developed. Such pumps usually have a dual-diameter pump chamber or body, generally the upper portion being a larger diameter than the lower portion. Separate pistons are provided in each of the different diameter portions, which pistons move together on downstroke and produce accumulation of pressure in the two chambers resulting in disengagement of the outlet valve whereby fluid is expressed through the atomizer nozzle at an instantaneously high pressure to produce fine atomization from the start of the spray until the end thereof. Accumulative pressure pumps having interconnected, different diameter pump chambers or bodies are shown in U.S. Pat. Nos. Re. 28,366; 3,746,260; 3,761,022; 3,796,375; 3,865,313; 3,907,206; 3,908,870; 3,921,861; 3,923,250; 3,940,030; 4,017,031; and 4,051,983.

The Invention

In accordance with the present invention there is provided a finger operated accumulative pressure spray pump which has two opposing and coaxial chambers. The upper chamber is fitted with an upper and middle piston urged upwardly by a spring, and the lower chamber is fitted with an opposing piston urged upwardly by a spring. A port connects the space between the two upper pistons with the external atmosphere.

An advantage of the present invention is that the pump will produce a highly atomized discharge with a small amount of finger pressure. Another important advantage is that any leakage that may occur will flow from the bottom of the pump into the fluid container. The discharge remains relatively uniform and does not vary substantially with the pressure exerted on the actuator.

The above advantages and other advantages will become apparent in the following drawings and description of the preferred embodiments.

DESCRIPTION OF THE PREFERRED EMBODIMENTS

Figure 1:
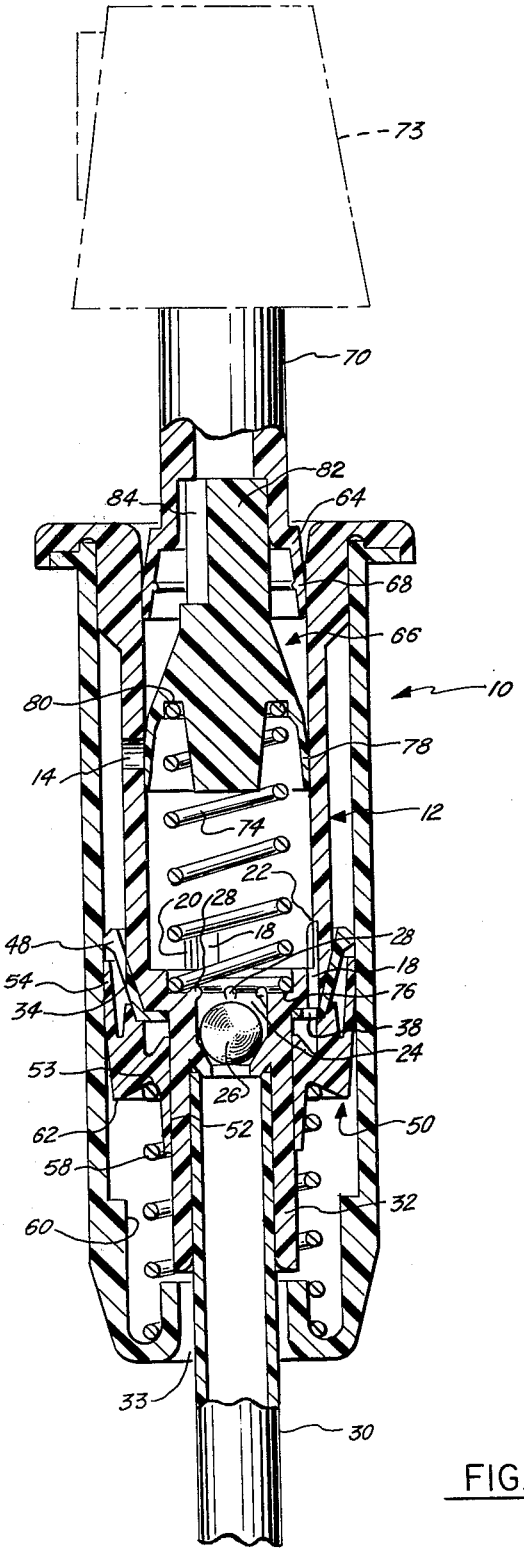
FIG. 1 is a partly cross-sectional, partly cut-away, elevational view of the pump of the present invention prior to actuation.
Figure 8:
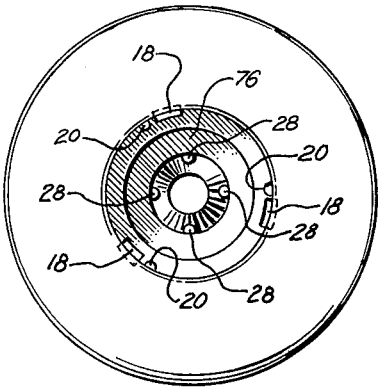
FIG. 8 is a top plan view of the inner cylindrical housing of the present invention; and, FIG. 9 is an elevational view of the inner cylindrical housing of the present invention.
Figure 9:
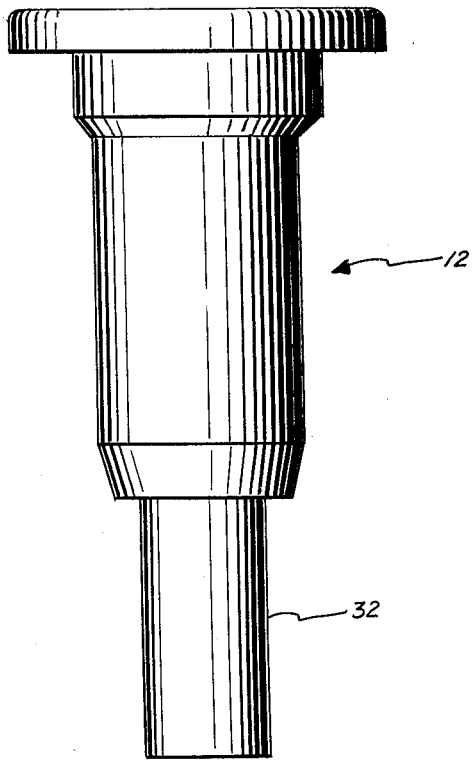

Referring now to the drawings, in FIG. 1 is shown a preferred embodiment of the accumulative spray pump of the present invention prior to actuation. The pump is contained in a generally cylindrical outer housing 10. At the upper end of housing 10 is inserted an inner cylindrical housing generally indicated by the numeral 12. Inner housing 12 is shown in greater detail in FIGS. 8 and 9. Located in the side of housing 12 is an orifice 14 through which liquid can flow.

Ports 18 are located in the lower end of housing 12 and extend through the base thereof. Located adjacent to ports 18 in the interior of housing 12 are nibs 20 having upper beveled edges 22. At the lower end of the interior of housing 12 is an inlet channel 24 which contains ball check valve 26. Ball check valve 26 is held in the inlet by a series of flexible tabs 28 which allow the ball to be forced into the inlet. A dip tube 30 is inserted into the cylindrical lower end 32 of housing 12 and extends through hole 33 in the bottom of housing 10 to a liquid reservoir or container (not shown).

Figure 6:
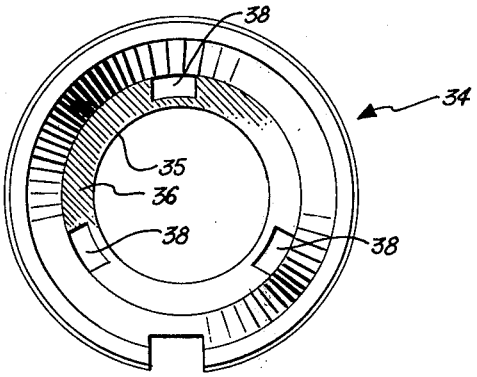
FIG. 6 is a top view of the one-way check valve of the present invention.
Figure 5:
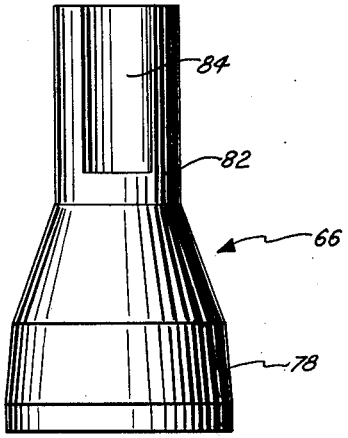
FIG. 5 is an elevational view of the middle piston of the present invention.
Figure 7:
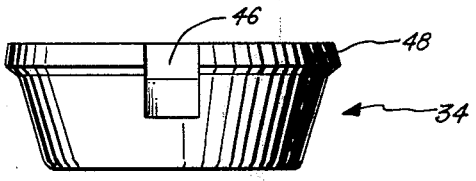
FIG. 7 is an elevational view of the one-way check valve of the present invention.

Located immediately beneath housing 12 is a cup-shaped seal generally indicated by the numeral 34 which can best be seen in FIGS. 6 and 7. Located in the bottom 36 of seal 34 are generally rectangular openings 38. Openings 38 are aligned with ports 18 in inner housing 12 to permit liquids to flow into and out of inner housing 12.

Also located in the bottom of seal 34 is circular hole 35. The lower end 32 of inner cylindrical housing 12 may be force-fitted into hole 35 as shown in FIG. 1 to help hold seal 34 thereon.

A recess 46 in check valve 34 allows liquid to flow upwards therethrough to orifice 14. A circular lip 48 surrounds the upper outside of seal 34 to provide a liquid seal against the interior of housing 10.

Located immediately beneath seal 34 is a bottom piston generally indicated by the numeral 50. Bottom piston 50 has a hollow cylindrical passage 52 in the center thereof which forms a sliding seal with the lower end 32 of housing 12. The upper outer wall 54 of bottom piston 50 forms a sliding seal with the inner wall of housing 10. A circular shoulder 56 strikes the bottom edge of seal 34 to limit the upper movement of bottom piston 50. The lower end of outer housing 10 fits loosely about dip tube 30 and does not form a seal with the lower end 32 of inner housing 12 so that air may be free to flow in and out of hole 33 in the lower end of outer housing 10 as lower piston 50 travels upwardly and downwardly. Also, any leakage that may occur will flow out of hole 33 into the liquid container (not shown).

Bottom piston 50 is biased upwardly by spring 58 which strikes the bottom 53 of bottom piston 50 and the bottom of housing 10. A series of nibs 60 located in the bottom interior of housing 10 limits the downward movement of bottom piston 50 when the lower shoulders 62 of bottom piston 50 strikes the nibs.

Figure 2:
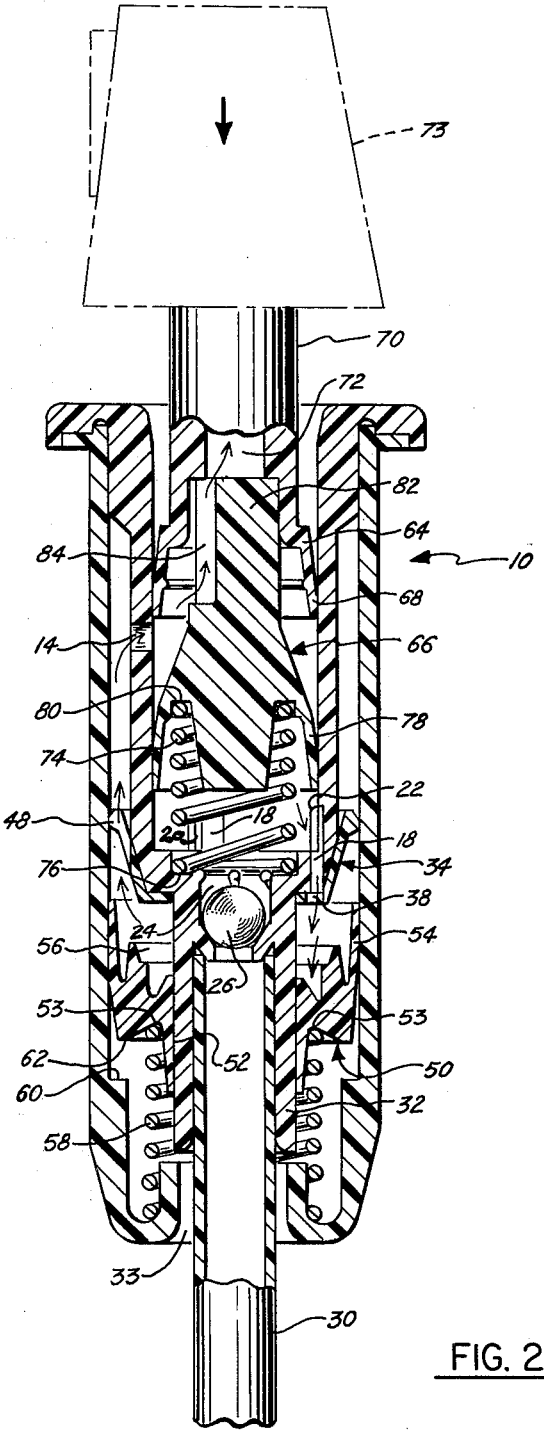
FIG. 2 is a partly cross-sectional, partly cut-away, elevational view of the pump of the present invention as the actuator is being depressed.
Figure 3:
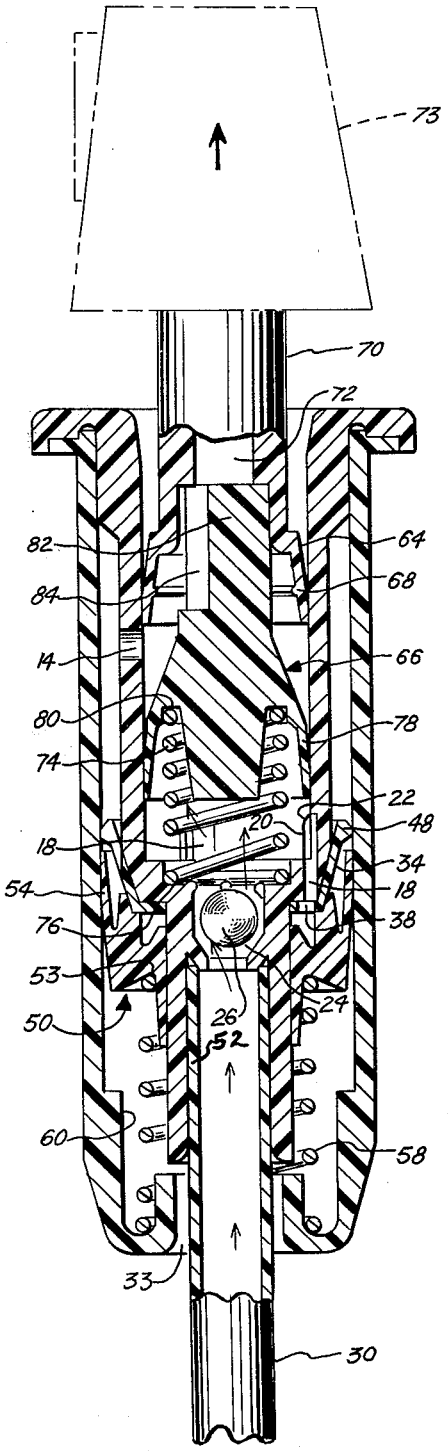
FIG. 3 is a partly cross-sectional, partly cut-away, elevational view of the pump of the present invention as the actuator is being released.
Figure 4:
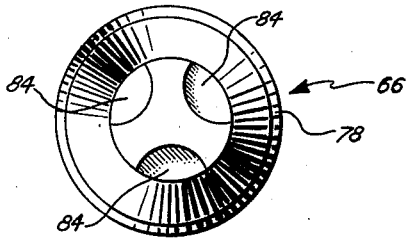
FIG. 4 is a top plan view of the middle piston of the present invention.

Located in the upper end of housing 12 are upper piston 64, shown in FIGS. 1–3, and a middle piston generally indicated by the numeral 66, shown in FIGS. 1–5. Upper piston 64 is an inverted cup-shaped piston having outer walls 68 which form a sliding seal with the interior of housing 12. Integrally molded with piston 64 is hollow stem 70 having an inner cylindrical discharge channel 72 through which liquid can flow. A typical button nozzle 73 is attached to the upper end of stem 70.

Immediately beneath and partly contained in upper piston 64 is middle piston 66. If desired, upper piston 64 and middle piston 66 can be molded as one piece or they may be molded as two pieces and rigidly fastened together by gluing or the like. Middle piston 66 is biased upwardly by spring 74 which presses against the bottom 76 of the interior of housing 12. Middle piston 66 has an outer wall 78 which forms a sliding seal with the interior wall of housing 12.

A recess 80 is formed in the bottom of middle piston 66 to snuggly receive spring 74. A stem 82 projects upwardly from middle piston 66 and has three channels 84 formed therein. Channels 84 align with channel 72 and stem 70 to permit liquids to flow upwardly from the interior of housing 12 into channel 72.

To operate the pump of the present invention the button on top of stem 70 is depressed by the finger of the operator, as shown in FIG. 2, and causes the upper piston 64 and middle piston 66 to move downwardly. Middle piston 66 forces air out of the interior of housing 12 beneath piston 66 outwardly through ports 18 and ports 38 out of housing 12. The air passing through ports 18 moves lower piston 50 downward slightly and flows upwardly through slot 46 and through orifice 14. From orifice 14 air flows upwardly through the interior of housing 12 through channels 84 and outwardly through channel 72 to the dispensing button 73. The remaining pressurized air in housing 12 beneath middle piston 66 is vented when the side wall 78 of middle piston 66 strikes the top of nibs 20 in inner housing 12 and is deflected allowing the air to flow past side wall 78 and through channels 84 and 72.

The pump is primed on the return stroke, as shown in FIG. 3, as lower piston 50 seals ports 18 in housing 12 by forming a seal against the bottom of seal 34 and ball check valve 26 floats upwardly to allow liquids to travel up dip tube 30 into inner housing 12. Once primed, on the next down stroke, as shown in FIG. 2, liquid is forced through ports 18 and ports 38 in seal 34 into the interior of housing 10 beneath seal 34 thus forcing lower piston 50 downward against the pressure of spring 58. Fluids flow upwardly when piston 50 is moved downwardly and through orifice 14 into the interior of housing 12. Liquids continue to flow upwardly through channels 84 and channel 72 and out through the nozzle 73 on stem 70 to the atmosphere as the button is depressed. Liquids will continue to be dispensed as long as lower piston 50 is depressed beneath seal 34 and is moving upwardly.

The terminal orifice of the discharge button is chosen to have a lower flow rate than the flow of liquid into the chamber beneath seal 34 so that a portion of the liquid is discharged and the remainder causes the lower piston to be displaced downward. If middle piston 66 is depressed to the point at which it strikes nibs 20, liquids will still flow out of the dispensing button at the same rate since the discharge button has a lower flow rate than the flow rate into the chamber. To stop the flow the button is released and lower piston 50 forces liquid up into inner housing 12 through ports 18 and 38 beneath middle piston 66. If the button 73 is held down, flow will continue until lower piston 50 strikes the bottom of seal 34.

On the up stroke of the upper and middle pistons, after lower piston 50 strikes seal 34, liquid is pulled up the dip tube 30 past ball check valve 26 to refill the upper chamber.

Although the preferred embodiments of the present invention have been disclosed and described in detail above, it should be understood that the invention is in no way limited thereby and its scope is to be determined by that of the following claims.

What is claimed:

1. A finger operated accumulative spray pump comprising:

a. an outer cylindrical housing having an upper end and a lower end;

b. an inner cylindrical housing fitted inside the upper ends of said outer cylindrical housing, said inner cylindrical housing having an inlet channel means in the lower end thereof for admitting liquid into the interior of said inner cylindrical housing, and a first valve means for preventing backflow of liquids through said inlet channel means of said inner cylindrical housing;

c. upper piston means slidably fitted in the upper end of said inner cylindrical housing, said upper piston having a stem connected thereto which has a stem channel therein through which liquids can flow;

d. middle piston means connected to said upper piston means and slidably fitted in said inner cylindrical housing beneath said upper piston means;

e. a first spring fitted inside said inner cylindrical housing to urge said middle piston upwardly;

f. port means located in said inner cylindrical housing for allowing liquids to flow from the inside to the outside of said inner cylindrical housing;

g. lower piston means slidably fitted around the outside of the lower end of said inner cylindrical housing, said lower piston forming a sliding seal with the interior of said outer cylindrical housing and said lower end of said inner cylindrical housing;

h. a second spring fitted inside the lower end of said outer cylindrical housing to urge said lower piston upwardly;

i. an orifice means located in the sidewall of said inner cylindrical housing for admitting liquids located on the outside of said inner cylindrical housing into the interior of said inner cylindrical housing between said upper piston and said middle piston; and, j. side channel means in said middle piston means aligned with said stem channel means in said upper piston for permitting liquids under pressure to flow upwardly through said stem.

2. The pump of claim 1 wherein said inner cylindrical housing has a series of nib means on the inside lower end thereof which strike said middle piston and deflect the outer edges of said middle piston inwardly to allow air or liquid beneath said middle piston to flow upwardly around the outside edges of said piston.

3. The pump of claim 1 wherein said outer cylindrical housing has a series of nib means on the inside lower end thereof which strike said lower piston means to limit the downward movement thereof.

4. The pump of claim 1 wherein said lower end of said channel has dip tube means fitted therein and aligned with said inlet channel means for conveying liquid to said inlet channel means.

5. The pump of claim 1 wherein said inner housing has a seal means connected thereto which is generally bowl-shaped and has a hole in the center thereof through which said lower end of said inner cylindrical housing is fitted.

6. The pump of claim 5 wherein said seal means has an upper outer edge which forms a seal with the inner wall of said outer cylindrical housing.

7. The pump of claim 6 wherein said seal means has two pair of adjacent guide means extending upwardly therefrom, each of said pair of guide means being adapted to receive one of two vertical rib means for channeling liquids located on the outside of said inner cylindrical housing.

8. The pump of claim 7 wherein said orifice means is located between said two rib means.

9. The pump of claim 1 wherein said orifice means is positioned so that liquids under pressure can flow into the interior of said inner cylindrical housing between said upper piston and said middle piston when said upper piston and said middle piston are in the uppermost postion.

10. The pump of claim 1 wherein air in said outer housing beneath said lower piston flows into and out of said outer housing through a hole in the bottom of said outer housing.

* * * * *